US005795141A

United States Patent [19]

Oki et al.

[11] Patent Number: 5,795,141

[45] Date of Patent: Aug. 18, 1998

[54] SCROLL TYPE COMPRESSOR HAVING ANTI-ROTATION PIN MEMBERS

[75] Inventors: Yasuhiro Oki, Okazaki; Shigeru Hisanaga, Kariya, both of Japan

[73] Assignees: Nippondenso, Co., Ltd; Kabushiki Kaisha, both of Kariya, Japan

[21] Appl. No.: 685,839

[22] Filed: Jul. 24, 1996

[30] Foreign Application Priority Data

Jul. 25, 1995 [JP] Japan ..... 7-189533

[51] Int. Cl.[6] ..... F04C 18/04

[52] U.S. Cl. ..... 418/55.3; 418/55.5; 418/57; 464/137

[58] Field of Search ..... 418/55.3, 55.5, 418/57; 464/102, 137

[56] References Cited

U.S. PATENT DOCUMENTS 4,954,056 9/1990 Muta et al. ..... 418/55.3

FOREIGN PATENT DOCUMENTS 0 652 371 5/1995 European Pat. Off. .
62-199983 9/1987 Japan .
1242824 9/1989 Japan ..... 464/137

OTHER PUBLICATIONS

Patent Abstracts of Japan, vol. 12, No. 52.

*Primary Examiner*—John J. Vrablik
*Attorney, Agent, or Firm*—Cushman Darby & Cushman IP Group of Pillsbury Madison & Sutro LLP

[57] ABSTRACT

A scroll type compressor comprises a housing and a fixed scroll. A movable scroll is incorporated therebetween, eccentrically engaging with the fixed scroll, and has a rotating center and a revolving center. Pin members are arranged on the end plate of the movable scroll and on the housing. At least one of the pin members of the movable scroll is positioned on a first line and disposed downstream of the corresponding pin member of the housing in the rotating direction, when the volume ratio of a compression chamber is from 10 to 22 percent of the volume of the compression chamber at the time of the conclusion of the suction of medium. The first line passes through the rotating center and is perpendicular to a second line, which passes through the rotating and revolving centers. The compressor also has annular ring members, which contact at least a pair of the pin members of the movable scroll and the housing, to prevent the movable scroll from rotating.

8 Claims, 5 Drawing Sheets

SCROLL TYPE COMPRESSOR HAVING ANTI-ROTATION PIN MEMBERS

BACKGROUND OF THE INVENTION

1. Field of the Invention

The present invention generally relates to a scroll type compressor incorporated in a climate control system in, e.g., an automobile, and more particularly relates to an anti-rotation device which prevents a movable scroll of the scroll type compressor from rotating about its own axis.

2. Description of the Related Art

Japanese Unexamined Patent Publication (Kokai) -No. 62-199983 discloses an anti-rotation device for a movable scroll, which prevents the movable scroll from rotating about its own axis. Namely, the anti-rotation device for the movable scroll includes pins of the scroll mounted on the end of an end plate of the movable scroll, pins of a housing mounted on an end surface of the housing and facing the pins of the scroll, and a ring cross-connected to the pins. Both the pins of the scroll and the pins of the housing contact an inner wall of the ring, so that the anti-rotation device prevents the movable scroll from rotating.

Moreover, the device has small gaps between both of the pins and the ring. Therefore, when the device is assembled, and when the amount of rotation of the movable scroll is zero, the spiral member of the movable scroll comes into contact with the spiral member of the fixed scroll before both of the pins come into contact with the inner wall of the ring.

However, as described above, since the device has small gaps between both of the pins and the ring, when the movable scroll is subjected to a rotational moment by means of a compression reaction during the compression process, the rotational moment causes the movable scroll to rotate with respect to the fixed scroll. Therefore, if the movable scroll rotates, the spiral member of the movable scroll cannot appropriately contact the spiral member of the fixed scroll, nor can the compression chamber be appropriately sealed off. Therefore, the rotation of the movable scroll gives rise to spaces among the areas of contact between the spiral member of the movable scroll and the spiral member of the fixed scroll, and to deterioration of the compression efficiency. Therefore, the amount of rotation of the movable scroll must be small in order to produce sufficient contact between the spiral member of the movable scroll and the spiral member of the fixed scroll.

Furthermore, since the amount of rotation of the movable scroll increases or decreases according to the rotational moment of the movable scroll, the scroll type compressor must have an anti-rotation device which makes the amount of rotation of the movable scroll small even if the rotational moment is at its maximum.

Now, as shown in FIG. 7, the rotational moment reaches its maximum every 360 degrees, for example, the maximum rotational moment occurs when the volume ratio of the compression chamber is 16 percent of the volume of the compression chamber at the time of conclusion of suction of the medium (refrigerant gas) in case that the suction pressure is 4 kgf/cm$^2$ ($3.92\times10^{-3}$ Pa) and the discharge pressure is 30 kgf/cm$^2$ ($2.94\times10^{-2}$ Pa). The inventors discovered that the maximum rotational moment occurs when the volume ratio is between 10 and 22 percent, after investigation thereof under several pressure conditions.

SUMMARY OF THE INVENTION

An object of the present invention is to provide a scroll type compressor to make the amount of rotation of a movable scroll small when the rotational moment is at its maximum.

Another object of the present invention is to provide an anti-rotation device for a movable scroll for a scroll type compressor, which prevents the movable scroll from rotating about its own axis.

A further object of the present invention is to provide an anti-rotation device used for a compressor of a climate control system in a vehicle.

According to the present invention, there is provided a scroll type compressor, comprising:

a housing having inlet and outlet openings;

a shaft pivotably supported with respect to the housing;

a fixed scroll connected within the housing and having an end, the fixed scroll having a spiral member on the end plate;

a movable scroll incorporated within the housing and having an end plate, the movable scroll including a spiral member on the end plate of the movable scroll, to eccentrically engage with the fixed scroll, and having a rotating center and a revolving center;

a compression chamber formed by the fixed scroll and the movable scroll;

a plurality of anti-rotation devices, each of the plurality of anti-rotation devices comprising:

a pin member of the movable scroll arranged on the end plate of the movable scroll, and projecting over the opposite side of the end plate of the movable scroll from the spiral member of the movable scroll;

a pin member of the housing arranged on the housing, projecting toward the movable scroll, and facing the pin member of the movable scroll; and an annular ring member having an inner surface and surrounding the pin members of the movable scroll and the housing; and the scroll type compressor disposing at least one of the pin members of the movable scroll on a first line and downstream of the pin members of the housing in the rotating direction, which constitute the same anti-rotation device together with said at least one of the pin members of the movable scroll, the first line passing through the rotating center and being perpendicular to a second line, the second line passing through the rotating center and the revolving center, said anti-rotation devices permitting the inner surfaces of the ring members to contact the pin member of the movable scroll and the pin member of the housing, to thereby prevent the movable scroll from rotating about the rotating center, when the volume ratio of the compression chamber is from 10 to 22 percent of the volume of the compression chamber at the time of the conclusion of the suction of medium.

According to another aspect of the present invention, there is provided a scroll type compressor, comprising:

a housing having inlet and outlet openings;

a shaft pivotably supported with respect to the housing;

a fixed scroll connected within the housing and having an end plate, the fixed scroll having a spiral member on the end plate of the fixed scroll;

a movable scroll incorporated within the housing and having an end plate, the movable scroll including a spiral member of the movable scroll on the end plate of the movable scroll, to eccentrically engage with the fixed scroll, and having a rotating center and a revolving center;

a compression chamber formed by the fixed scroll and the movable scroll;

a plurality of anti-rotation devices, each of the plurality of anti-rotation devices comprising:

a pin member of the movable scroll arranged on the end plate of the movable scroll, projecting over the opposite side of the end plate of the movable scroll from the spiral member of the movable scroll, and having a cylindrical surface; and a pin member of the housing arranged on the housing, projecting toward the movable scroll, having a cylindrical surface of the pin member of the housing, and facing the pin member of the movable scroll; and the scroll type compressor disposing at least one of the pin members of the movable scroll on a first line and upstream of the pin members of the housing in the rotating direction, which constitute the same anti-rotation device together with said at least one of the pin members of the movable scroll, the first line passing through the rotating center and being perpendicular to a second line, the second line passing through the rotating center and the revolving center, said anti-rotation devices permitting the cylindrical surfaces of the pin members of the movable scroll to contact the cylindrical surfaces of the pin members of the housing, to thereby prevent the movable scroll from rotating about the rotating center, when the volume ratio of the compression chamber is from 10 to 22 percent of the volume of the compression chamber at the time of the conclusion of the suction of medium.

Preferably, the movable scroll is connected to the shaft via a drive key and a key groove, each of the drive key and the key groove having a substantially rectangular section, and the length of the key groove being slightly larger than the length of the drive key in section, to make the drive key movable in the key groove in the longitudinal direction.

Further, the housing also has an outlet muffler connected to the outlet opening, to smooth pulses of the compressed medium.

Still further, the outlet muffler has a check valve formed of spring steel, to prevent the compressed medium from flowing inversely.

Therefore, in accordance with the invention, a scroll type compressor can be obtained, which makes the amount of rotation of a movable scroll small when its rotational moment is at its maximum.

The various features of novelty which characterize the invention are pointed out in detail in the claims annexed to and forming a part of this specification. For a better understanding of the invention, its operating advantages, and specific objects attained by its use, reference is made to the accompanying drawings and descriptive matter in which a preferred embodiment of the invention is illustrated.

BRIEF DESCRIPTION OF THE DRAWINGS

The above and other objects, features and advantages of the present invention will be made more apparent from the ensuing description of preferred embodiments thereof in conjunction with the accompanying drawing wherein.

DESCRIPTION OF THE PREFERRED EMBODIMENTS

Figure 1:
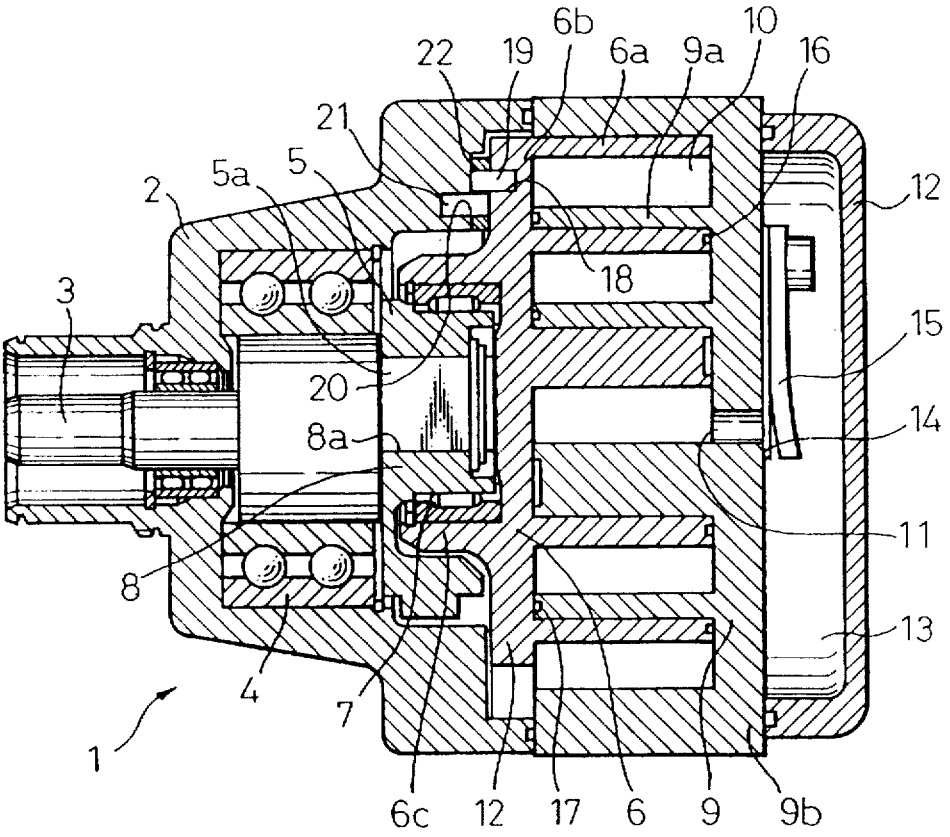
FIG. 1 is an axial cross-section view of a scroll type compressor according to the first preferred embodiment of this invention.

With reference to the first preferred embodiment of this invention, a compressor 1 including a spiral-shaped movable scroll and a spiral-shaped fixed scroll, is illustrated in FIG. 1. Reference numeral 2 shows a front housing (or a housing) of the compressor 1. A bearing 4 is arranged substantially in the center of the front housing, in order to pivotably support a crank shaft 3. A drive key 5*a* is placed to the right side of the crank shaft 3 in FIG. 1, and is integrally and eccentrically formed with the crank shaft 3.

Figure 2:
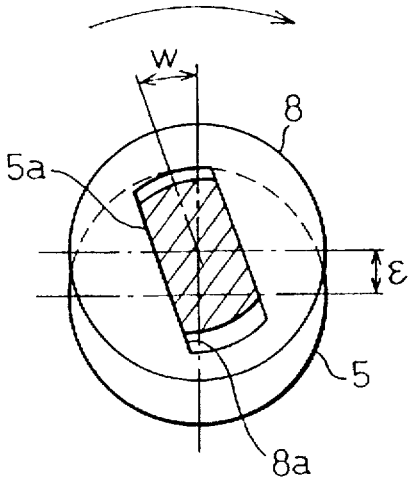
FIG. 2 is a section view of a crank portion according to this embodiment.

A movable scroll 6 is arranged on the end of the front housing 2 facing the drive key 5*a*, and has a spiral member 6*a*. The movable scroll 6 has a boss 6*c* in the center, into which a bearing 7 is press-fitted. A bush 8 is inserted into the bearing 7, and faces the inner face of the bearing 7. The bush 8 has a key groove 8*a*, into which the drive key 5*a* is inserted. As shown in FIG. 2, the drive key 5*a* and the key groove 8*a* have substantially rectangular sections.

In FIG. 2, the length of the key groove 8*a* is slightly larger than the length of the drive key 5*a*. The drive key 5*a* is movable in the key groove 8*a* in the longitudinal direction. As shown in FIG. 2, the longitudinal direction of the drive key 5*a* or the key groove 8*a* forms an angle w together with the vertical direction, in the opposite direction to a revolving direction. A crank portion 5 has the above mentioned drive key 5*a*, bush 8 and key groove 8*a*.

Again, in FIG. 1, reference numeral 9 shows a fixed scroll having a spiral member 9*a*. The fixed scroll 9 is secured to the front housing 2 with bolts (not shown), and forms a closed space 10 together with the front housing 2. The movable scroll 6 revolves within this space 10 around a revolving axis of the crank shaft 3.

An end plate 9*b* of the fixed scroll 9 has an outlet opening 11 substantially in the center of the end plate. The outlet opening 11 ejects compressed medium, and communicates with a space formed between the end plate 9*b* of the fixed scroll 9 and the rear housing 12. Said space forms an outlet muffler 13 which smooths pulses of the compressed medium. A check valve 14 formed of spring steel is attached to the outlet opening 11 facing the outlet muffler 13, and prevents the compressed medium from flowing inversely. The check valve 14 has a stopper 15 which adjusts the quantity of flow of the compressed medium.

The compressor 1 has tip seals 16 and 17 formed of resin, such as the resin under the trademark Teflon in this embodiment, between the spiral member 6*a* of the movable scroll 6 and the spiral member 9*a* of the fixed scroll 9 in order to seal the compression chamber.

Figure 3:
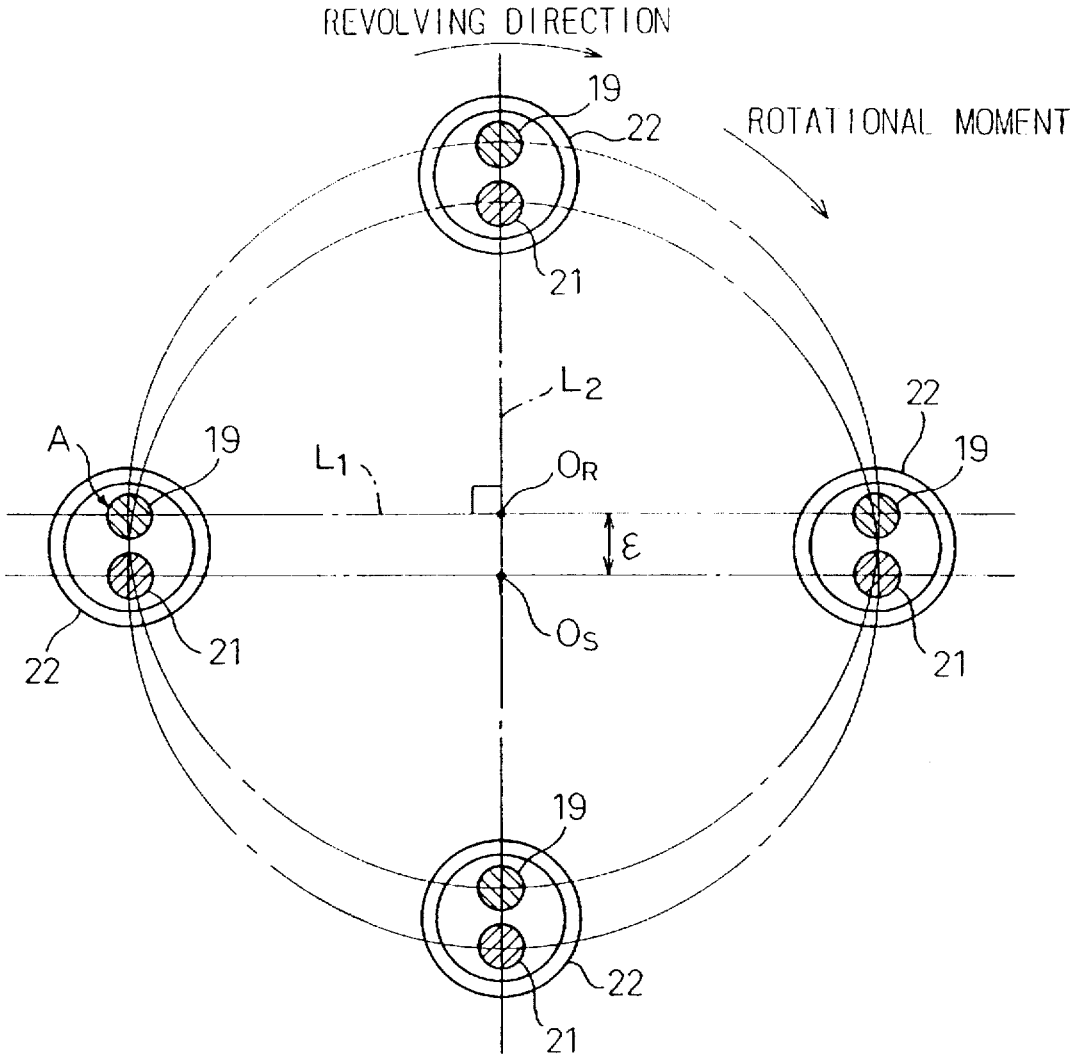
FIG. 3 is a section view showing only a configuration of a pin member of a movable scroll, a pin member of a housing, and a ring member, according to this embodiment.

An end plate 6*b* of the movable scroll 6 has circular holes 18 in areas of the periphery of the end plate 6*b*. A plurality of cylindrical pin members 19 of the movable scroll are press-fitted into the holes 18. (In this embodiment, as shown in FIG. 3, there are four holes 18.) A surface of the front housing 2 facing the end plate 6*b* has circular holes 20, which are offset from the pin members 19 of the movable scroll, and which form pairs together with the pin members 19 of the movable scroll. Also, a plurality of cylindrical pin members 21 of the housing are press-fitted into the holes 20. Both of the pin members 19 and 21 have great wear resistance, and are formed of metal material having high strength. (In this embodiment, the metal material is high carbon chromium bearing steel.)

Reference numeral 22 shows an annular ring member formed of high carbon chromium bearing steel. Both of the pin members 19 and 21 are arranged as shown in FIG. 3, and penetrate the ring members 22. In FIG. 3, the relative positions of pairs of the pin members 19 and 21 and the ring members 22 are shown, and the boss 6*c*, the bearing 7 and the crank portion 5 are omitted.

Figure 4:
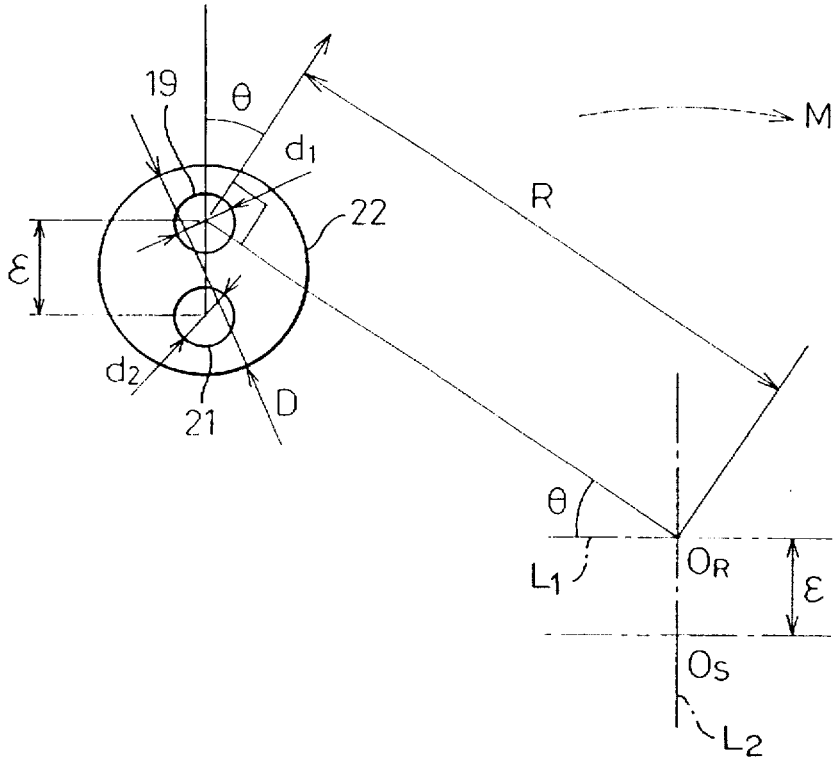
FIG. 4 is a view explaining an arrangement of the pin member of the movable scroll, the pin member of the housing, and the ring member, before a rotational moment is applied to a movable scroll.
Figure 5:
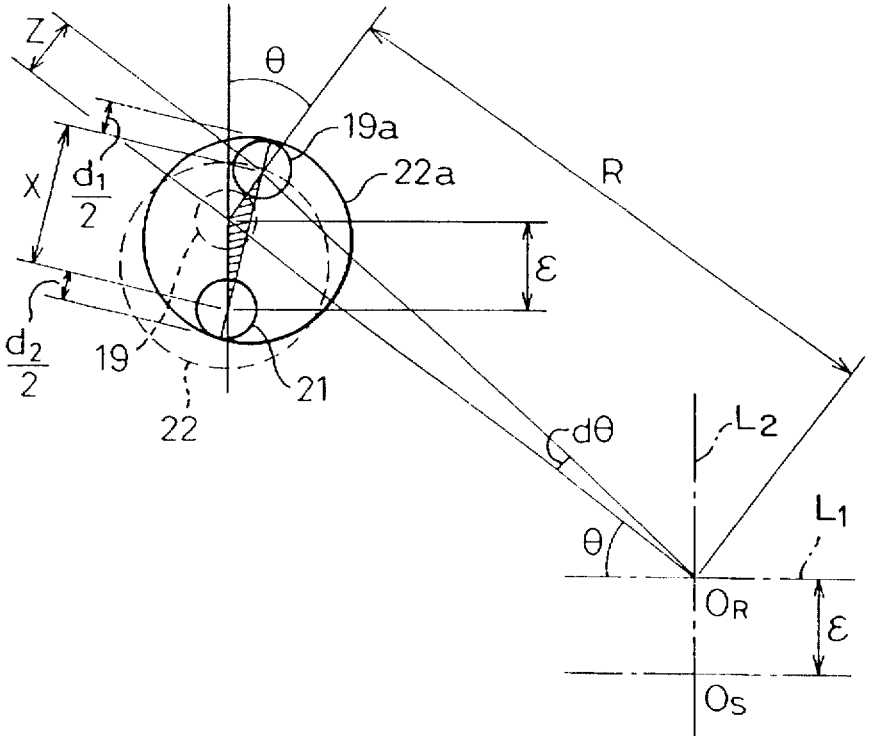
FIG. 5 is a view explaining an arrangement of the pin member of the movable scroll, the pin member of the housing, and the ring member, after the rotational moment has been affected to the movable scroll.

FIGS. 4 and 5 show an anti-rotation device for the movable scroll 6 in detail which has the pin member 19 of the movable scroll, the pin member 21 of the housing, and ring member 22. In FIGS. 4 and 5, only the inner diameter of the ring member 22 is shown, and its outer diameter is omitted.

A rotating moment M of the movable scroll 6 is produced around an axis (OR in FIGS. 4 and 5) of the movable scroll 6, the direction of the moment being clockwise in this embodiment. FIG. 4 shows the configuration of the anti-rotation device (including both of the pin members 19 and 21 and the ring member 22) before the rotational moment M is applied to the movable scroll 6. Then, after the rotational moment M affects the movable scroll 6, as shown in FIG. 5, the pin member 19 moves to the position, shown as a pin member 19*a*, in the direction of the rotational moment M, and also the ring member 22 moves to the position, shown as a ring member 22*a*, in the direction of the rotational moment M. Therefore, both of the pin members 19 and 21 contact an inner wall of the ring member 22, and a force opposing the rotational moment M is produced, so that a rotation of the movable scroll 6 is prevented.

When the volume ratio of the compression chamber formed with the movable scroll 6 and the fixed scroll 9 is from 10 to 22 percent of the volume of the compression chamber at the time of the conclusion of the suction of the medium, the relative positions of both of the pin members 19 and 21 and the ring members 22 have the following features. As shown in FIG. 3, when viewed from the axial direction of the crank shaft 3, at least one of the pin members 19 of the movable scroll is positioned on a line $L_1$. (In FIG. 3, said at least one of the pin members 19 of the movable scroll is the one indicated by an arrow A in this embodiment.) The line $L_1$ is perpendicular to the line $L_2$ and passes through a rotating center $O_R$ of the movable scroll 6. The line $L_2$ passes through the rotating center $O_R$ of the movable scroll 6 and a revolving center $O_S$ of the movable scroll 6. Said pin member 19 of the movable scroll is positioned toward the downstream of rotating direction of the movable scroll 6 with respect to the pin member 21 of the housing, which is surrounded together with said pin member 19 by the same ring member 22 (that is, which constitutes a pair together with said pin member 19).

The amount of rotation of the movable scroll 6 and a position of the pin member 19 of the movable scroll will appear from the following description with reference to the following marks in which:

$d_1$ shows a diameter of the pin member 19 of the movable scroll;

$d_2$ shows a diameter of the pin member 21 of the housing;

D shows an inner diameter of the ring member 22;

$\epsilon$ shows a revolving radius (which is a distance between the rotating center $O_R$ of the movable scroll 6 and the revolving center $O_S$ of the movable scroll 6);

R shows a distance between the center of the pin member 19 of the movable scroll and the rotating center $O_R$;

$L_2$ shows a line which passes through the rotating center $O_R$ and the revolving center $O_S$;

$L_1$ shows a line which passes through the rotating center $O_R$ and is perpendicular to the line $L_2$;

$\theta$ shows an angle (in radians) between the line $L_1$ and a line which passes through the center of the pin member 19 of the movable scroll and the rotating center $O_R$ ($0 \leqq \theta \leqq \pi/2$);

$d\theta$ shows the amount of rotation (in radians) of the movable scroll 6;

z shows a displacement of the pin member 19 of the movable scroll; and x shows a distance between the center of the pin member 19*a* of the movable scroll and the center of the pin member 21 of the housing, after the pin member 19 has moved to the position of the pin member 19*a*.

As shown in FIG. 5, since the gap between the pin member 19 of the movable scroll and the inner diameter of the ring member 22 or between the pin member 21 of the housing and the ring member 22 is small, the amount of rotation $d\theta$ of the movable scroll 6 is extremely small, so that it can be considered that the pin member 19 of the movable scroll moves linearly along the displacement z.

Then, the cosine theorem is applied to a crosshatched triangle in FIG. 5, and a mathematical expression (1) can be obtained.

$$x^2=z^2+\epsilon^2+2\cdot z\cdot\epsilon\cdot\cos\theta \quad (1)$$

Then, the mathematical expression (1) is transformed to the mathematical expression (2), and z can be obtained from the mathematical expression (2).

$$z=-\epsilon\cdot\cos\theta+(x^2-\epsilon^2\cdot\sin^2\theta)^{1/2}(z\geqq 0) \quad (2)$$

Then, a partial differential equation (3) is obtained from the mathematical expression (2) in order to derive the minimum displacement z.

$$\partial z/\partial\theta=(\epsilon\cdot\sin\theta\cdot(-\epsilon\cdot\cos\theta+(x^2-\epsilon^2\cdot\sin^2\theta)^{1/2})/(X^2-\epsilon^2\cdot\sin^2\theta)^{1/2} \quad (3)$$

Then, the partial differential equation (3) is transformed to the mathematical expression (4).

$$\partial z/\partial\theta=(\epsilon\cdot z\cdot\sin\theta)/(x^2-\epsilon^2\cdot\sin^2\theta)^{1/2}\geqq 0 \quad (4)$$

Therefore, while $\theta$ is between 0 (radian) and $\pi/2$ (radian), the rate of change of the displacement z of the pin member 19 of the movable scroll is equal to 0 or more than 0, so that the displacement z is at its minimum when $\theta$ is equal to 0. Also, as described above, since the displacement z is extremely small, the amount of rotation $d\theta$ of the movable scroll 6 is equal to z/R, and is at its minimum when $\theta$ is equal to 0.

Here, since it is considered that $x=(D-d_1/2-d_2/2)$, the mathematical expression (5) can be obtained.

$$z=(D-d_1/2-d_2/2)-\epsilon \quad (5)$$

It will be appreciated that the amount of rotation of the movable scroll 6 can be small, when the pin member 19 of the movable scroll is positioned on a line $L_1$ and when θ is equal to 0. The line $L_1$ passes through the rotating center $O_R$ of the movable scroll 6 and is perpendicular to a line $L_2$. The line $L_2$ passes through the rotating center $O_R$ of the movable scroll and the revolving center $O_S$ of the movable scroll.

Therefore, the spiral member 6a of the movable scroll can securely contact the spiral member 9a of the fixed scroll. The compression chamber formed with both of the spiral members 6a and 9a can be completely sealed. A compression process can be reliably achieved.

Though the first embodiment describes the anti-rotation device for the movable scroll which includes the pin members 19 and 21 and the ring member 22, this invention can achieve an anti-rotation device without the ring member 22.

Figure 6:
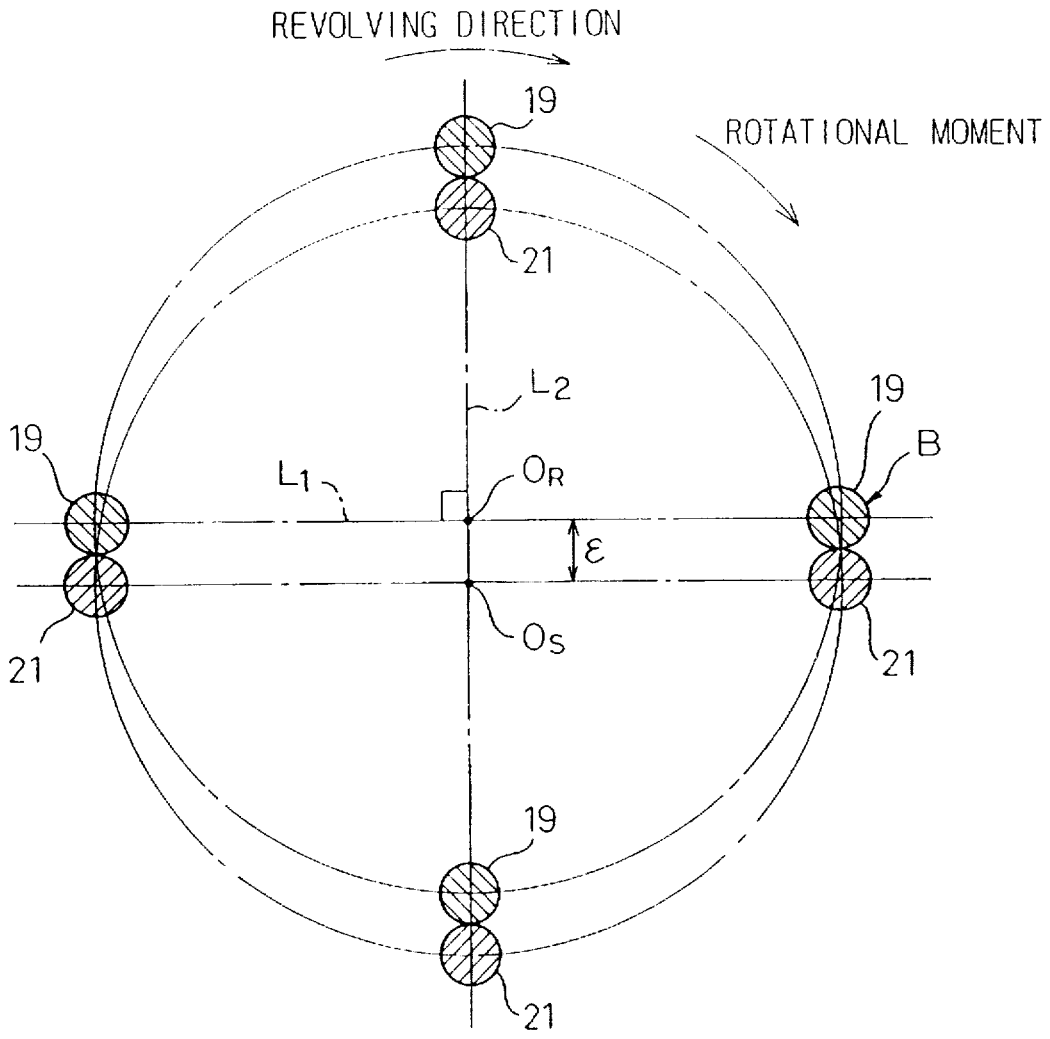
FIG. 6 is a section view showing only a configuration of a pin member of a movable scroll and a pin member of a housing, according to the second embodiment of this invention.
Figure 7:
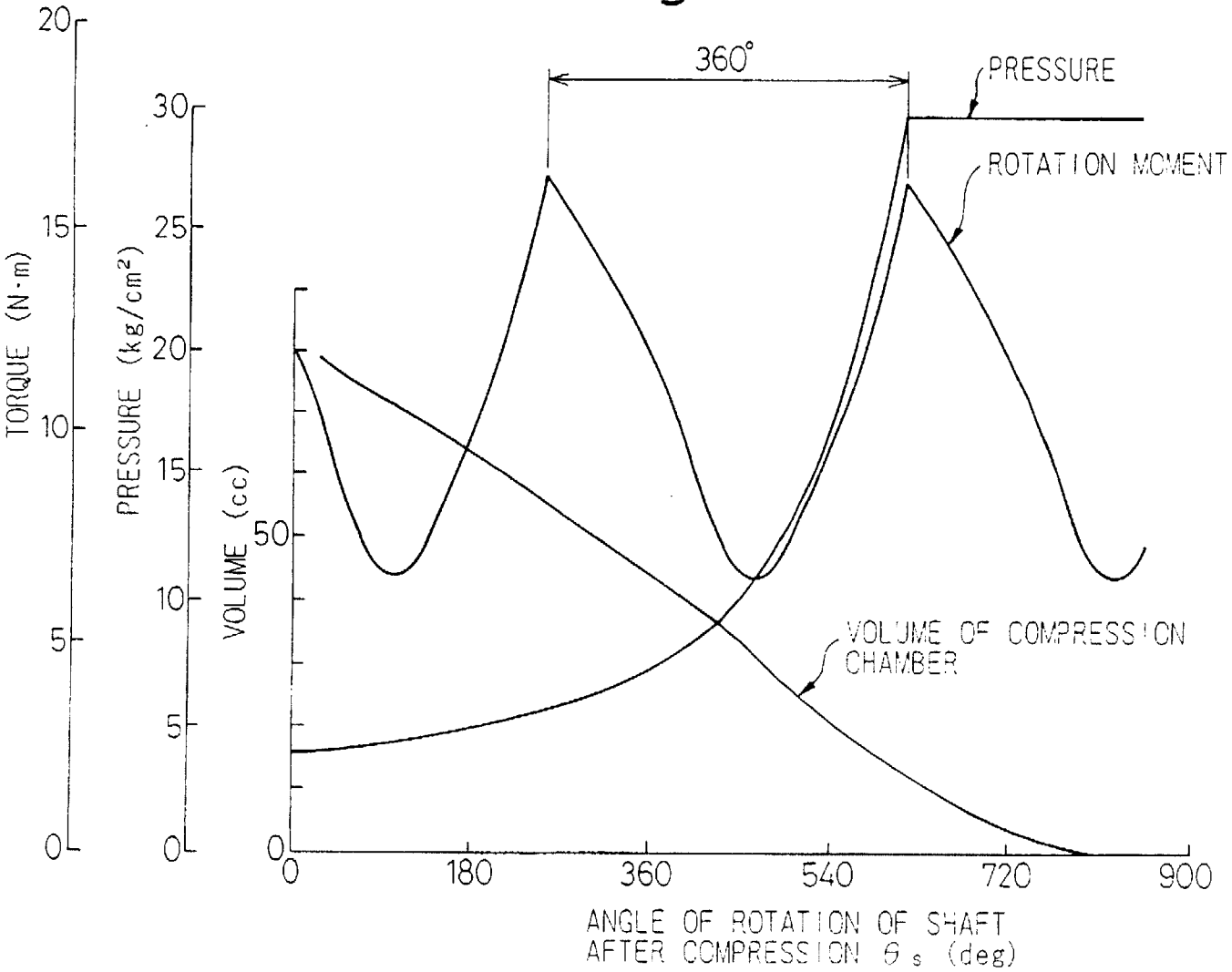
FIG. 7 is a graph showing a relation between an angle of a crank shaft and rotational moment applied to a movable scroll.

With reference to the second preferred embodiment, the configuration of a scroll type compressor which has pin members 19 of the movable scroll is shown in FIG. 6, as it is the same as the configuration in FIG. 3 except that the ring members 22 are excluded. In FIG. 6, the relative positions of the pairs of the pin members 19 and 21 are shown, and the boss 6c, the bearing 7 and the crank portion 5 are omitted.

As shown in FIG. 6, a pin member 19 of the movable scroll which is indicated by an arrow B is positioned on the line $L_1$ (θ is equal to 0). The line $L_1$ passes through the rotating center $O^R$ of the movable scroll and is perpendicular to the line $L_2$. The line $L_2$ passes through the rotating center $O_R$ of the movable scroll and the revolving center $O_S$ of the movable scroll. Also, this pin member 19 of the movable scroll constitutes a pair together with a pin member 21 of the housing. The pin member 21 of the housing is positioned downstream of the rotating direction of the movable scroll 6 with respect to the pin member 19 of the movable scroll. Thus, rotation of the movable scroll 6 will cause the upstream pin "B" to contact the associated pin 21 of the housing, which will prevent rotation of the movable scroll with respect to the housing.

Thus, in accordance with the invention, there has been provided a scroll type compressor which makes the amount of rotation of a movable scroll small when the rotational moment is at its maximum.

Further, there has been provided an anti-rotation device for a movable scroll for a scroll type compressor.

Also, there has been provided an anti-rotation device used for a compressor of a climate control system in a vehicle.

While the above description constitutes the preferred embodiment of the present invention, it will be appreciated that the invention is susceptible to modification, variation and change without departing from the proper scope and fair meaning of the accompanying claims.

What is claimed is:

1. A scroll type compressor, comprising:

a housing having inlet and outlet openings;

a shaft pivotably supported with respect to the housing;

a fixed scroll connected within the housing and having an end plate, the fixed scroll having a spiral member on the end plate of the fixed scroll;

a movable scroll incorporated within the housing and having an end plate, the movable scroll including a spiral member on the end plate of the movable scroll to eccentrically engage with the fixed scroll, and having a rotating center and a revolving center;

a compression chamber formed by the fixed scroll and the movable scroll; and a plurality of anti-rotation devices, each of the plurality of anti-rotation devices comprising:

a pin member arranged on the end plate of the movable scroll, and projecting from an opposite side of the end plate of the movable scroll from the spiral member of the movable scroll;

an associated pin member arranged on the housing, projecting toward the movable scroll, and facing the pin member of the movable scroll; and an annular ring member having an inner surface and surrounding the pin members of the movable scroll and the housing, wherein, to reduce rotation of the movable scroll, at least one of the pin members of the movable scroll is disposed on a first line and downstream of the associated pin member of the housing in the rotating direction, when the volume ratio of the compression chamber is from 10 to 22 percent of the volume of the compression chamber at the time of the conclusion of the suction of medium and a rotating moment acting on the movable scroll due to compression of the medium is greatest, the first line passing through the rotating center and being perpendicular to a second line, the second line passing through the rotating center and the revolving center, said anti-rotation devices permitting the inner surfaces of the ring members to contact the pin member of the movable scroll and the pin member of the housing to thereby prevent the movable scroll from rotating about the rotating center.

2. A scroll type compressor according to claim 1, wherein the movable scroll is connected to the shaft via a drive key and a key groove, each of the drive key and the key groove having a substantially rectangular section, and the length of the key groove is slightly larger than the length of the drive key in section, to make the drive key relatively movable in the key groove in the longitudinal direction.

3. A scroll type compressor according to claim 1, wherein the housing also has an outlet muffler connected to the outlet opening, to smooth pulses of compressed medium.

4. A scroll type compressor according to claim 3, wherein the outlet muffler has a check valve formed of spring steel, to prevent the compressed medium from flowing inversely.

5.A scroll type compressor, comprising:

a housing having inlet and outlet openings;

a shaft pivotably supported with respect to the housing;

a fixed scroll connected within the housing and having an end plates, the fixed scroll having a spiral member on the end plate of the fixed scroll;

a movable scroll incorporated within the housing and having an end plate, the movable scroll including a spiral member on the end plate of the movable scroll to eccentrically engage with the fixed scroll, and having a rotating center and a revolving center;

a compression chamber formed by the fixed scroll and the movable scroll; and a plurality of anti-rotation devices, each of the plurality of anti-rotation devices comprising:

a pin member arranged on the end plate of the movable scroll, projecting from an opposite side of the end plate of the movable scroll from the spiral member of the movable scroll, and having a cylindrical surface; and an associated pin member arranged on the housing, projecting toward the movable scroll, having a cylindrical surface of the pin member of the housing, and facing the pin member of the movable scroll, wherein, to reduce rotation of the movable scroll, at least one of the pin member of the movable scroll is disposed on a first line and upstream of the associated pin members of the housing in the rotating direction when the volume ratio of the compression chamber is from 10 to 22 percent of the volume of the compression chamber at the time of the conclusion of the suction of medium, and a rotating moment acting on the movable scroll due to compression of the medium is greatest, the first line passing through the rotating center and being perpendicular to a second line, the second line passing through the rotating center and the revolving center, said anti-rotation devices permitting the inner surfaces of the pin members of the movable scroll to contact the cylindrical surfaces of the pin members of the housing, to thereby prevent the movable scroll from rotating about the rotating center.

6. A scroll type compressor according to claim 5, wherein the movable scroll is connected to the shaft via a drive key and a key groove, each of the drive key and the key groove having a substantially rectangular section, and the length of the key groove is slightly larger than the length of the drive key in section, to make the drive key relatively movable in the key groove in the longitudinal direction.

7. A scroll type compressor according to claim 5, wherein the housing also has an outlet muffler connected to the outlet opening, to smooth pulses of compressed medium.

8. A scroll type compressor according to claim 7, wherein the outlet muffler has a check valve formed of spring steel, to prevent the compressed medium from flowing inversely.

* * * * *